US007421233B2

(12) United States Patent
Yamagishi et al.

(10) Patent No.: US 7,421,233 B2
(45) Date of Patent: Sep. 2, 2008

(54) DEVELOPING DEVICE AND IMAGE FORMING APPARATUS

(75) Inventors: Yoshihiro Yamagishi, Osaka (JP); Eiji Nimura, Osaka (JP); Takaaki Kamei, Osaka (JP); Asami Kotera, Osaka (JP); Koji Suenami, Osaka (JP)

(73) Assignee: Kyocera Mita Corporation (JP)

( * ) Notice: Subject to any disclaimer, the term of this patent is extended or adjusted under 35 U.S.C. 154(b) by 174 days.

(21) Appl. No.: 11/394,039

(22) Filed: Mar. 29, 2006

(65) Prior Publication Data

US 2006/0222409 A1 Oct. 5, 2006

(30) Foreign Application Priority Data

Mar. 30, 2005 (JP) ..... 2005-098809
Feb. 24, 2006 (JP) ..... 2006-047838

(51) Int. Cl.
*G03G 15/08* (2006.01)

(52) U.S. Cl. ..... 399/256

(58) Field of Classification Search ..... 399/254–256
See application file for complete search history.

(56) References Cited

U.S. PATENT DOCUMENTS 5,963,766 A * 10/1999 Okuno et al. ..... 399/256
6,577,834 B2 * 6/2003 Suzuki ..... 399/254

FOREIGN PATENT DOCUMENTS

| | | | |
|---|---|---|---|
| JP | 2001-255723 | | 9/2001 |
| JP | 2002031940 A | * | 1/2002 |
| JP | 2003107859 A | * | 4/2003 |
| JP | 2003-167421 | | 6/2003 |

* cited by examiner

*Primary Examiner*—Ryan Gleitz
(74) *Attorney, Agent, or Firm*—Gerald E. Hespos; Anthony J. Casella

(57) ABSTRACT

A developing device (100) according to the present invention is provided with a housing (102) for holding toner, conveying screws (104, 105) arranged in the housing (2) and each including a rotary shaft (107) and a blade (106) arranged on the rotary shaft (107) for conveying the toner from one end of the rotary shaft (107) toward the other end thereof by the rotation of the rotary shaft (107), and a developing roller (103) provided in the housing with a part of the developing roller (103) being exposed from the housing, and rotatable to obtain the toner conveyed by the conveying screws (104, 105). The conveying screws (104, 105) are constructed, for the efficient agitation of the toner, such that toner pressing forces of the blades (106) differ depending the angle of rotation of the rotary shaft (107).

9 Claims, 11 Drawing Sheets

DEVELOPING DEVICE AND IMAGE FORMING APPARATUS

BACKGROUND OF THE INVENTION

1. Field of the Invention

The present invention relates to a developing device used for the image development in an image forming apparatus such as a copier, a composite apparatus, or a printer, and an image forming apparatus using the same.

2. Description of the Background Art

A developing device 900 used upon developing a latent image formed on a photosensitive drum of an image forming apparatus into a visible image is disposed at a position proximate to a photosensitive drum 901 as shown in FIG. 9. The developing device 900 is provided with a housing 902 holding toner, a developing roller 903 supported on the housing 902, and conveying screws 904, 905. Blades 906 having a spiral shape and a uniform diameter for agitating and circulating the toner in the housing 902 are provided on rotary shafts 907 of the conveying screws 904, 905 (see Japanese Unexamined Patent Publication No. 2001-255723).

As shown in FIG. 10, the developing roller 903 is constructed such that the outer circumferential surface of a magnet roller 908 is covered by a developing sleeve 909. The magnetic roller 908 has a five-pole structure. The magnetic roller 908 is fixed, whereas the developing sleeve 909 is rotatable. The toner in the housing 902 agitated and circulated by the conveying screws 904, 905 is conveyed to the outside of the housing 902 by the rotation of the developing roller 903.

A charger 910 for charging the toner conveyed by the developing roller 903 is disposed above the developing roller 903 in the housing 902. The toner conveyed to the outside by the developing roller 903 is supplied to the photosensitive drum 901 while having specified electric charges given thereto by this charger 910 and having an amount thereof restricted to a specified amount.

The outer circumferential surface of the photosensitive drum 901 is uniformly charged, and a latent image is thereafter formed thereon by a laser. A charged state at a position where the latent image was formed in this way is such that the charged toner supplied from the developing roller 903 is attached thereto. Thus, the toner supplied from the developing roller 903 attaches only at the position where the latent image was formed.

Out of the toner supplied to the photosensitive drum 901, the one that has not been attached to the photosensitive drum 901 is collected into the housing 902 by remaining on the developing roller 903. When the toner that has not been attached to the photosensitive drum 901 is collected into the housing 902, the charged toner is present in the housing 902. If the thus collected toner is supplied again to the photosensitive drum 910 by the developing roller 903, electric charges are given thereto by the charger 901 upon the supply to the photosensitive drum 901 despite the fact that the toner is already charged. Since the toner is excessively charged if electric charges are given thereto again, there occurs a development error such as the attachment of the toner to a part of the outer circumferential surface of the photosensitive drum 901 where no latent image is formed.

A development error as above occurs also when the collected toner is locally present in part of the interior of the housing 902 instead of being uniformly present in the housing 902, and the locally present collected toner is supplied to the photosensitive drum 901 by the developing roller 903.

In order to avoid such a development error, in the developing device 900, the toner is agitated by the conveying screws 904, 905 to uniformly disperse the charged toner in the housing 902.

However, with the conveying screws provided with the spiral blades having a uniform diameter disclosed in Japanese Unexamined Patent Publication No. 2001-255723, the flow rate of the toner circulating in the housing is constant and the toner cannot be sufficiently agitated since a conveying ability is uniform at any position along the axial direction of the rotary shafts of the conveying screws.

Further, if the toner is pressed more by the conveying screws in order to improve the agitation efficiency, an externally added agent (e.g. abrasive) is buried in the outer surfaces of toner particles or come off from the outer surfaces of toner particles due to resulting stresses, wherefore a toner conveyance error occurs due to the excessive charging of the toner and a reduction in the fluidity of the toner.

SUMMARY OF THE INVENTION

It is an object of the present invention to provide a developing device which can efficiently agitate toner, and an image forming apparatus using such a developing device.

In order to accomplish this object, according to an aspect of the present invention, a developing device, comprising: a housing for holding toner, a conveying screw arranged in the housing, and including a rotary shaft and a blade provided on the rotary shaft for conveying the toner from one end of the rotary shaft toward the other end thereof by the rotation of the rotary shaft, and a developing roller provided in the housing in a state where a part of the developing roller is exposed from the housing, and rotatable to obtain the toner conveyed by the conveying screw. A toner pressing force of the blade differ depending on the angle of rotation of the rotary shaft.

When the conveying screw is rotated with the toner filled in the housing, the toner is agitated by the blade of the conveying screw while circulating in the housing. Since the conveying screw is formed such that the toner pressing force differ depending on the angle of rotation of the rotary shaft, a toner conveying ability partly differs along the axial direction of the rotary shaft. In other words, the flow rate of the toner differs depending on the position along the axial direction of the rotary shaft and the toner is agitated at positions where there is a difference in the flow rate. Therefore, the toner can be sufficiently agitated while the deterioration thereof is prevented.

DETAILED DESCRIPTION OF THE PREFERRED EMBODIMENTS

Figure 1:
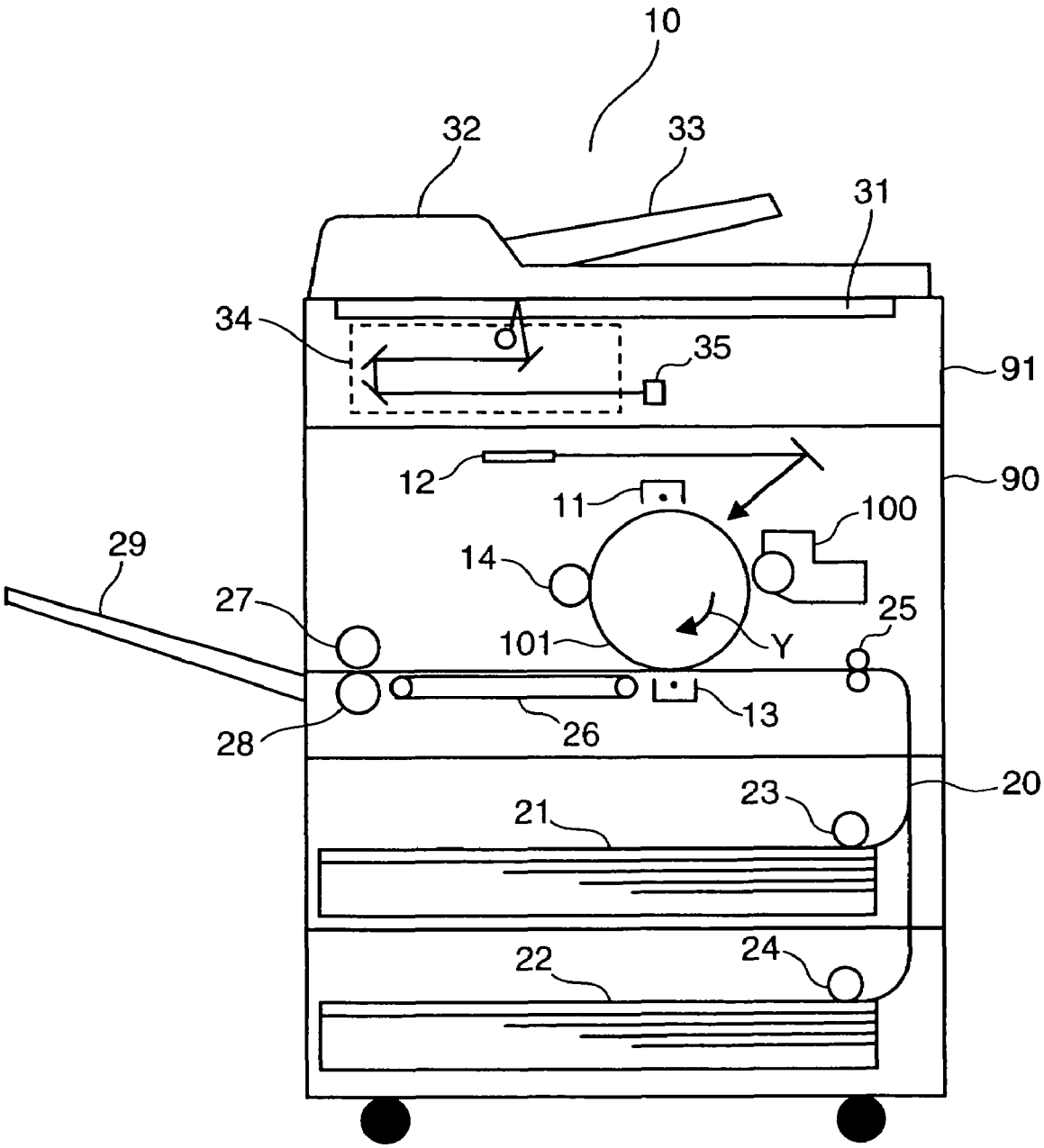
FIG. 1 is a schematic diagram of a copier having a built-in developing device according to one embodiment of the invention.

FIG. 1 is a diagram showing an internal construction of a copier 10 (one example of an image forming apparatus according to the present invention) having a built-in developing device 100 according to one embodiment of the present invention. As shown in FIG. 1, the copier 10 is provided with a main unit 90 and a scanner unit 91 arranged above the main unit 90 for reading a document image.

A photosensitive drum 101 (image bearing body) for bearing an electrostatic latent image is disposed inside the main unit 90. A charger 11 for substantially uniformly charging the outer circumferential surface of the photosensitive drum 101, a laser 12 (exposure unit) for forming an electrostatic latent image corresponding to a document image on the outer circumferential surface of the photosensitive drum 101 using a laser beam, the developing device 100 for forming a toner image on the outer circumferential surface of the photosensitive drum 101 by attaching toner to the formed electrostatic latent image, a transfer device 13 for transferring the toner image formed on the outer circumferential surface of the photosensitive drum 101 to a sheet, and a charge removing device 14 for removing electric charges residual on the outer circumferential surface of the photosensitive drum 101 after the transfer of the toner image are arranged around the photosensitive drum 101 in this order along a rotating direction of the photosensitive drum 101 indicated by an arrow Y in FIG. 1.

Figure 2:
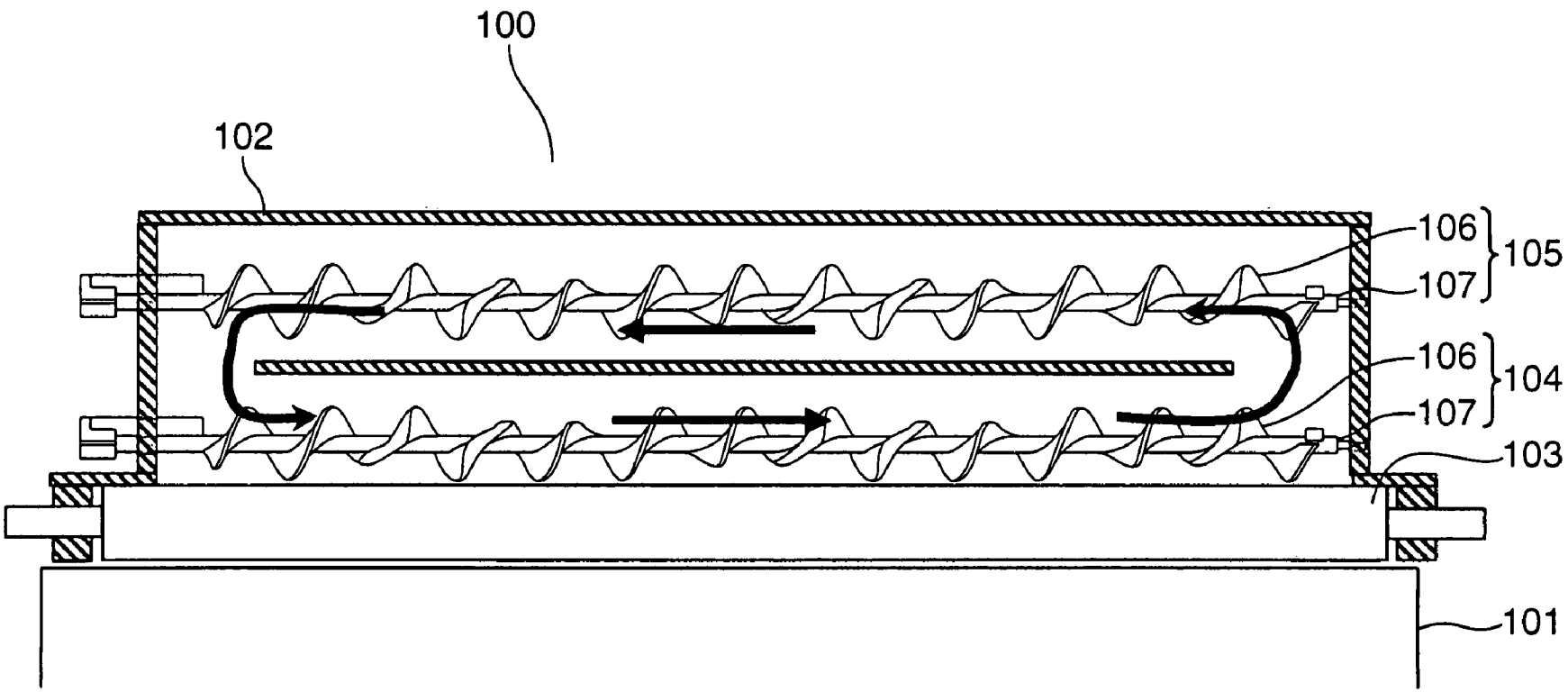
FIG. 2 is a plan view partly in section of the developing device.
Figure 3:
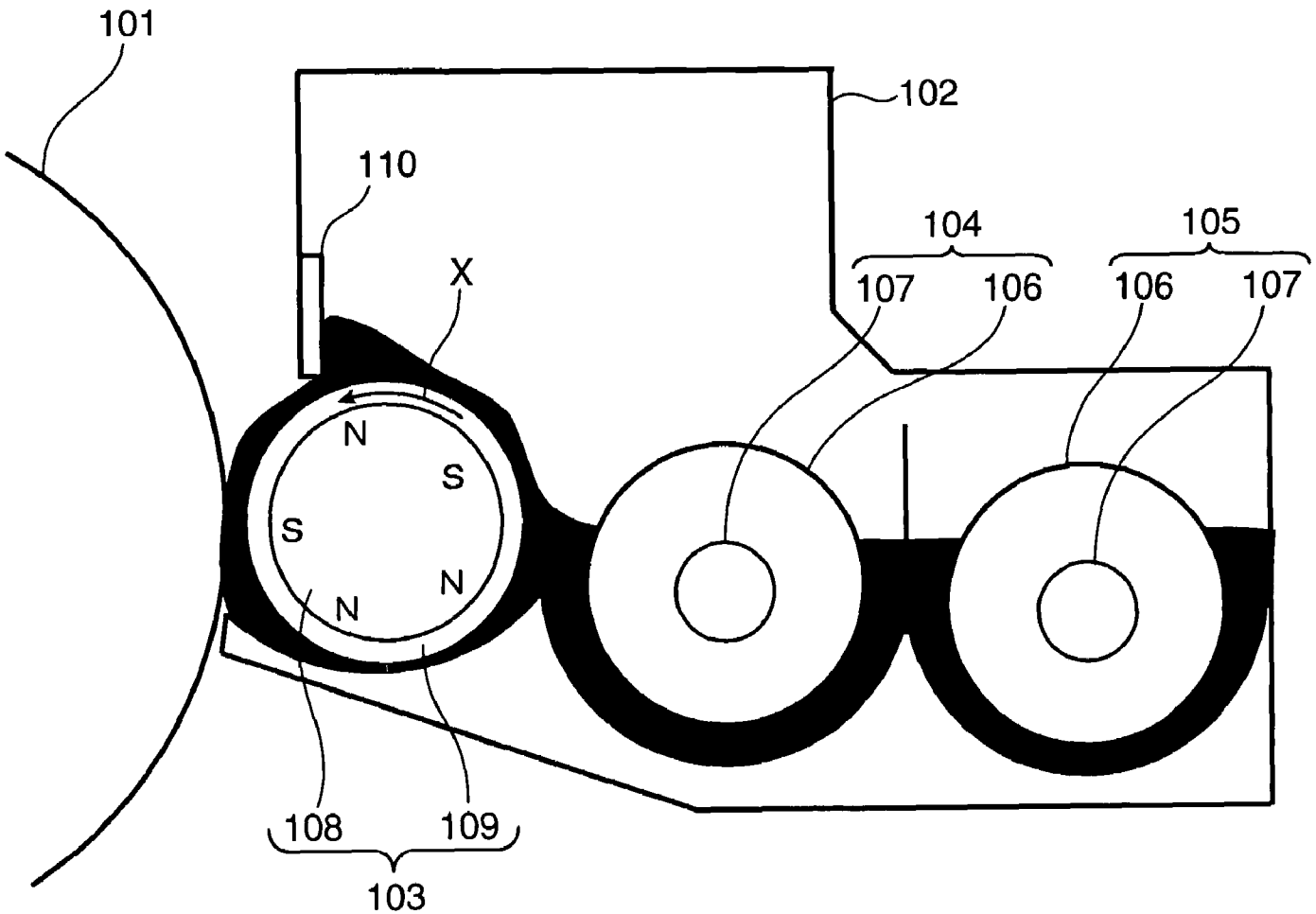
FIG. 3 is a section of the developing device.

As shown in FIGS. 2 and 3, the developing device 100 includes a housing 102, conveying screws 104, 105 provided in the housing 102, and a developing roller 103. A part of the developing roller 103 is exposed from the housing 102 while the other part of the developing roller 103 faces the inside of the housing 102. A charger 110 is also provided as shown in FIG. 3.

Figure 4A:
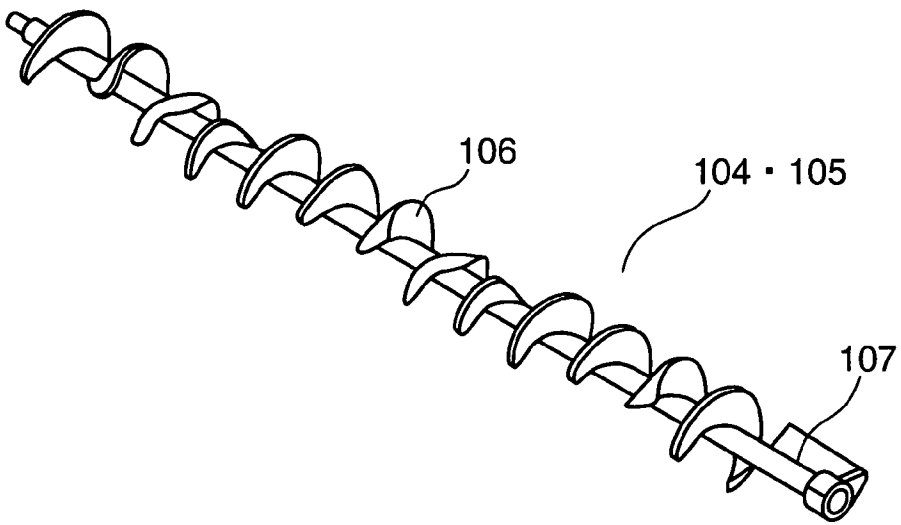
FIGS. 4A and 4B are a perspective view and a plan view of a conveying screw built in the developing device.
Figure 4B:
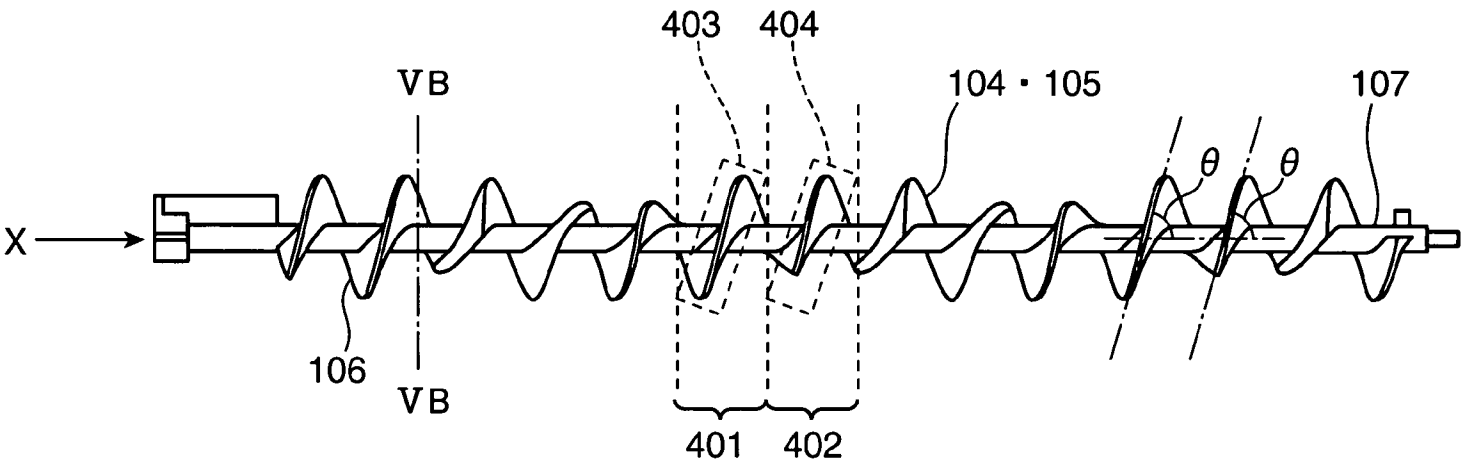
Figures 5A, 5B, 5C, 5D, 5E, 5F, 5G, 5H:
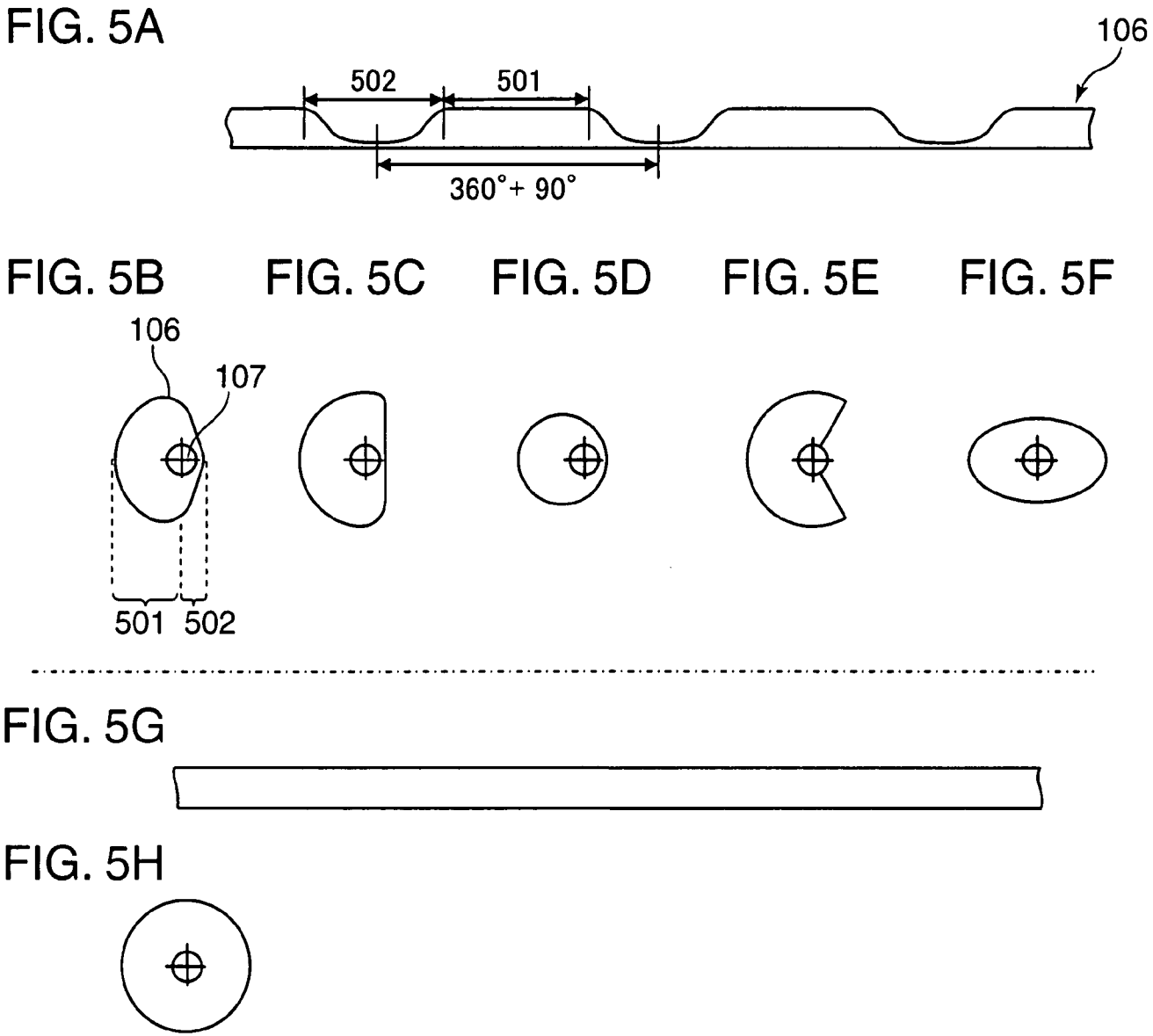
FIGS. 5A to 5I are diagrams showing a plurality of examples of the conveying screw provided with larger blade portions and smaller blade portions.

Each of the conveying screws 104, 105 has a spirally shaped blade 106 extending along a rotary shaft 107 from a position near one end of the rotary shaft 107 to a position near the other end thereof in order to agitate and circulate (convey) toner in the housing 102. The blade 106 has a spiral shape continuous from the position near the one end of the rotary shaft 107 to the position near the other end thereof by connecting larger blade portions having a larger diameter and smaller blade portions having a diameter smaller than that of the larger blade portions with the rotary shaft 107 as a center as shown in FIGS. 4A and 4B, which are a perspective view and a plan view of the conveying screw 104, 105, respectively. FIG. 5A shows a virtual diagram if the blade 106 of FIG. 4 were detached from the rotary shaft 107 and developed on a plane surface. It is assumed that the blade has no thickness and no twist upon being developed. It can be understood that larger blade portions 501 whose distance (diameter) from the outer circumferential surface of the rotary shaft 107 is longer along vertical direction and smaller blade portions 502 having a shorter distance (diameter) from the rotary shaft 107 than the larger blade portions 501 are alternatively connected in the blade 106. In the conveying screw 104, 105 shown in FIG. 4A, there is an angular displacement of 360°+90°, i.e. 450° on the rotary shaft 107 between the center of one smaller blade portion 502 to the adjacent smaller blade portion 502.

In FIG. 5G, for clear understanding, is shown a development of the blade provided on the conventional conveying screws 904, 905 that is spiral in shape and give the uniform toner pressing force at any rotational angle. It will be seen from this figure that the blade has no larger blade portion and smaller blade portion.

Further, a side view of the conveying screw at a cross section along VB-VB of FIG. 4B when viewed in an axial direction (X) is shown in FIG. 5B. As shown in FIG. 5B, the blade 106 has the larger blade portions 501 and the smaller blade portions 502 around the rotary shaft 107. For better understanding, a section of the ordinary conveying screw 904, 905 is shown in FIG. 5H. It can be understood that the ordinary conveying screw 904, 905 has neither larger blade portions nor smaller blade portions.

Similar to the conventional developing device, the developing roller 103 is constructed such that the outer circumferential surface of a magnetic roller 108 is covered by a developing sleeve 109 rotatable in a direction of an arrow X as shown in FIG. 3. As shown in FIG. 3, the magnetic roller 108 has a five-pole structure having five poles. The magnetic roller 108 is fixed, whereas the developing sleeve 109 is rotatable.

The charger 110 is disposed above the developing roller 103 inside the housing 102 for imparting electric charges to the toner conveyed to the outside of the housing 102 by staying on the outer surface of the developing roller 103.

Referring back to FIG. 1, the main unit 90 includes sheet feeding cassettes 21, 22 for storing sheets used for copying. Feed rollers 23, 24 for dispensing sheets stored in the sheet feeding cassettes 21, 22 one by one from the sheet feeding cassettes 21, 22 to feed them to a conveyance path 20 are respectively provided above the sheet feeding cassettes 21, 22.

Conveyance rollers 25 for conveying the fed sheet to a downstream side is provided at an intermediate position of the conveyance path 20. The sheet is conveyed by the conveyance rollers 25 to a clearance between the photosensitive drum 101 and the transfer device 13, and has a toner image formed on the photosensitive drum 101 transferred thereto upon passing this clearance. The sheet having passed the photosensitive drum 101 and the transfer device 13 is conveyed by a conveyance belt 26 and the like to a nip between a fixing roller 27 and a pressure roller 28. The sheet conveyed to the nip between the fixing roller 27 and the pressure roller 28 has the toner image fixed thereto by the fixing roller 27 and the pressure roller 28. The sheet having the toner image fixed thereto is discharged onto a discharge tray 29 by unillustrated discharge rollers thereafter.

The scanner unit 91 is provided with a document table 31, an ADF (automatic document feeder) 32, a placing table 33 on which documents to be fed by the ADF 32 are placed, an optical system 34 for reading a document, and image pickup means 35 including a CCD (charge-coupled device) for generating an image data of the document read by the optical system 34.

In the case of copying by means of the copier 10, a user presses an unillustrated start key down. When the start key is pressed down, the copier 10 judges whether or not any document is placed on the document table 31 or the placing table 33. If any document is placed on the document table 31, the copier 10 reads the document placed on the document table 31 using the optical system 34. On the other hand, if any document is placed only on the placing table 33, the copier 10 reads the document by means of the optical system 34 while feeding the document on the placing table 33 using the ADF 32.

An image data is generated by the image pickup means 35 for the document read by the optical system 34.

Further, when the start key is pressed down, the copier 10 causes the photosensitive drum 101 to rotate in the direction of an arrow Y and causes the charger 11 to uniformly charge the outer circumferential surface of the photosensitive drum 101. When the image data is generated by the image pickup means 35, the copier 10 causes a latent image corresponding to the image data to be formed on the outer circumferential surface of the photosensitive drum 101 by irradiating the photosensitive drum 101 by means of the laser 12.

Further, the copier 10 causes the developing sleeve 109 of the developing device 100 to rotate, whereby the toner is attached to the photosensitive drum 101 having the latent image formed thereon to generate a toner image by developing the latent image.

Simultaneously with the document reading and the toner image formation as above, the copier 10 causes the feed roller 23, 24 to feed a sheet stored in the corresponding sheet feeding cassette 21, 22 to the conveyance path 20 when the start key is pressed down. Further, the copier 10 causes the conveyance rollers 25 to convey the sheet to the clearance between the photosensitive drum 101 and the transfer device 13 when the toner image formed on the photosensitive drum 101 reaches the position facing the transfer device 13. The sheet passing between the photosensitive drum 101 and the transfer device 13 has the toner image transferred thereto. Thereafter, the sheet has the toner image fixed thereto by the fixing roller 27 and the pressure roller 28 and is discharged onto the discharge tray 29.

The conveying screws 104, 105 provided in the developing device 100 according to the present invention are rotated constantly or at regular intervals by a motor provided in the copier 10. Upon the rotation of the conveying screws 104, 105, the toner filled in the housing 102 is agitated while being conveyed along a direction of arrows in FIG. 2 (counterclockwise direction) by the blades 106.

As described above, the blades 106 of the conveying screws 104, 105 are such that larger-diameter portions and smaller-diameter portions are alternately arranged. The larger-diameter portions, i.e. the larger blade portions of the blades 106 have a higher toner conveying ability, whereas the smaller-diameter portions, i.e. the smaller blade portions have a lower conveying ability. Thus, if the toner is conveyed by the conveying screws 104, 105 provided with the blades 106 including the larger blade portions and the smaller blade portions, there are sections where the flow rate of the toner is faster and those where it is slower. At boundaries between the sections of the faster flow rate and those of the slower flow rate, the toner is efficiently agitated due to a difference in the flow rate.

Since a plurality of larger blade portions and a plurality of smaller blade portions are provided in the conveying screws 104, 105, the toner is agitated at a plurality of places. This enables a pressure for agitation at one place to be reduced, i.e. it is not necessary to apply an excessive pressure to the toner upon agitating the toner. Accordingly, an occurrence of an undesired situation can be prevented where the toner is deteriorated due to the excessive charging and a reduction in fluidity because an externally added agent is buried in toner particles or comes off from the toner particles due to stresses caused by the applied pressure.

The fluidity of the toner is lower around the developing roller 103 because of magnetic forces acting between the magnetic roller 108 of the developing device 103 and the toner. Accordingly, in the developing device 100 of this embodiment, the conveying ability of the conveying screw 104 closer to the developing roller 103 may be set to be larger than that of the more distant conveying screw 105 if the two conveying screws 104, 105 are arranged at one side of the developing roller 103.

Figure 5I:
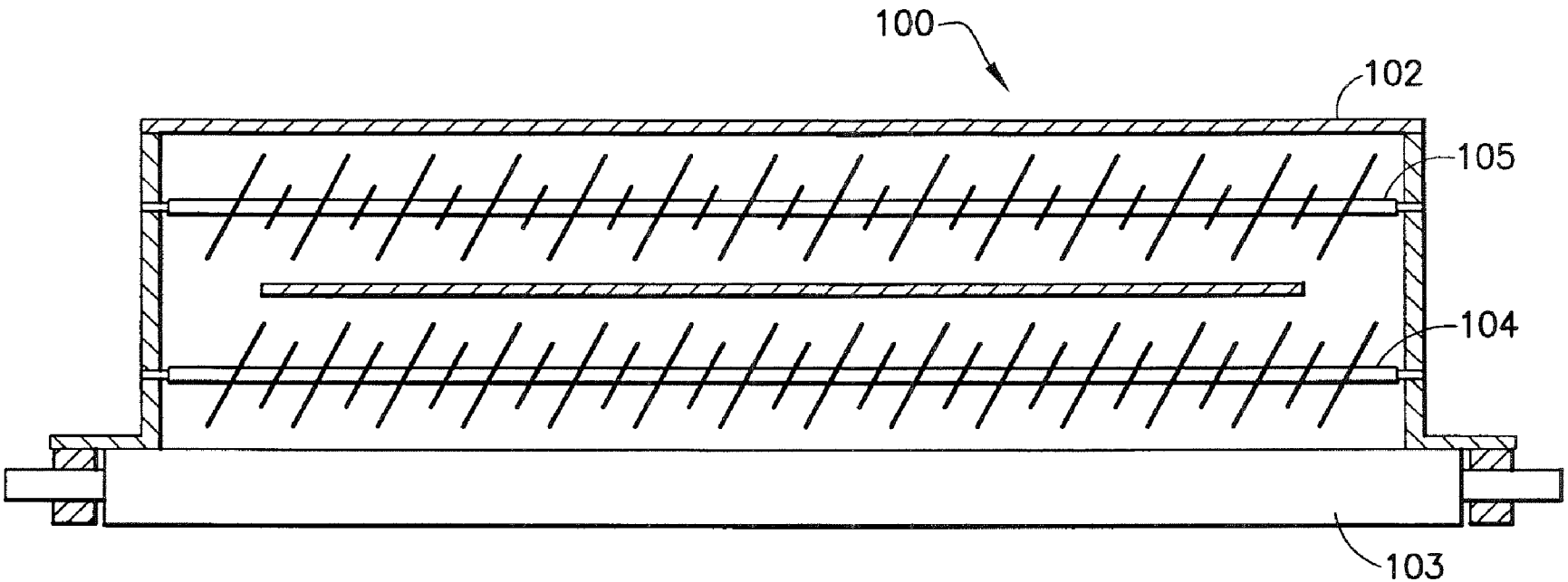

As means for increasing a conveying force, the diameter of the smaller-diameter portions of the blade 106 may be set to be larger in the conveying screw 104 closer to the developing roller 103 than in the conveying screw 105 more distant from the developing roller 103, as shown in FIG. 5I. In other words, the smaller blade portions of the conveying screw 104 arranged at a position closer to the developing roller 103 are made larger than those of the conveying screw arranged 105 at a position more distant from the developing roller 103.

Near the developing roller, the conveyance of the toner is hindered by the magnetic forces of the magnetic roller inside the developing roller. Thus, by setting the diameter of the smaller-diameter portions of the blade 106 to be larger in the conveying screw closer to the developing roller than in the conveying screw more distant from the developing roller, the toner can be suitably conveyed near the developing roller.

Figure 9:
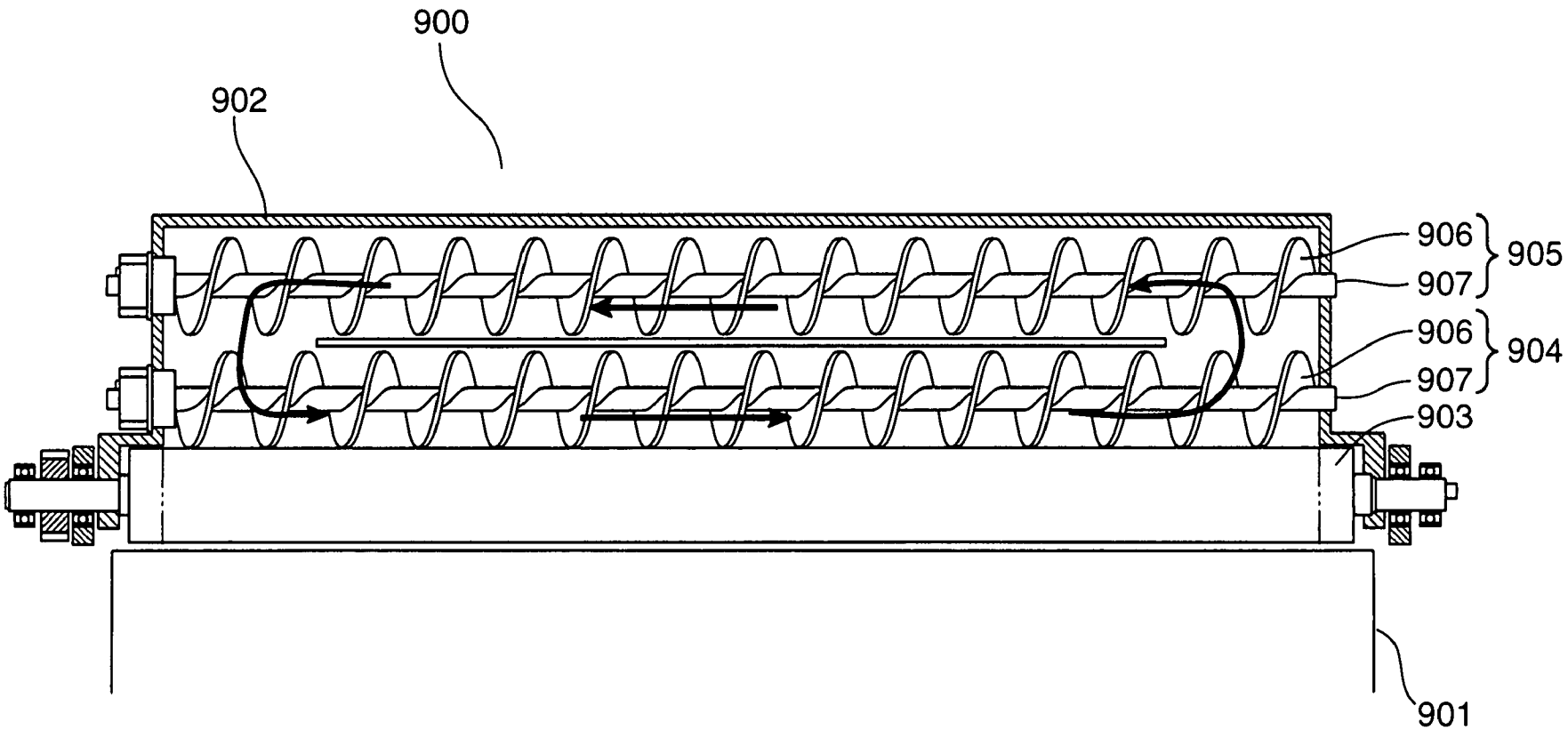
PRIOR ART FIG. 9
FIG. 9 is a plan view of a conventional developing device.
Figure 10:
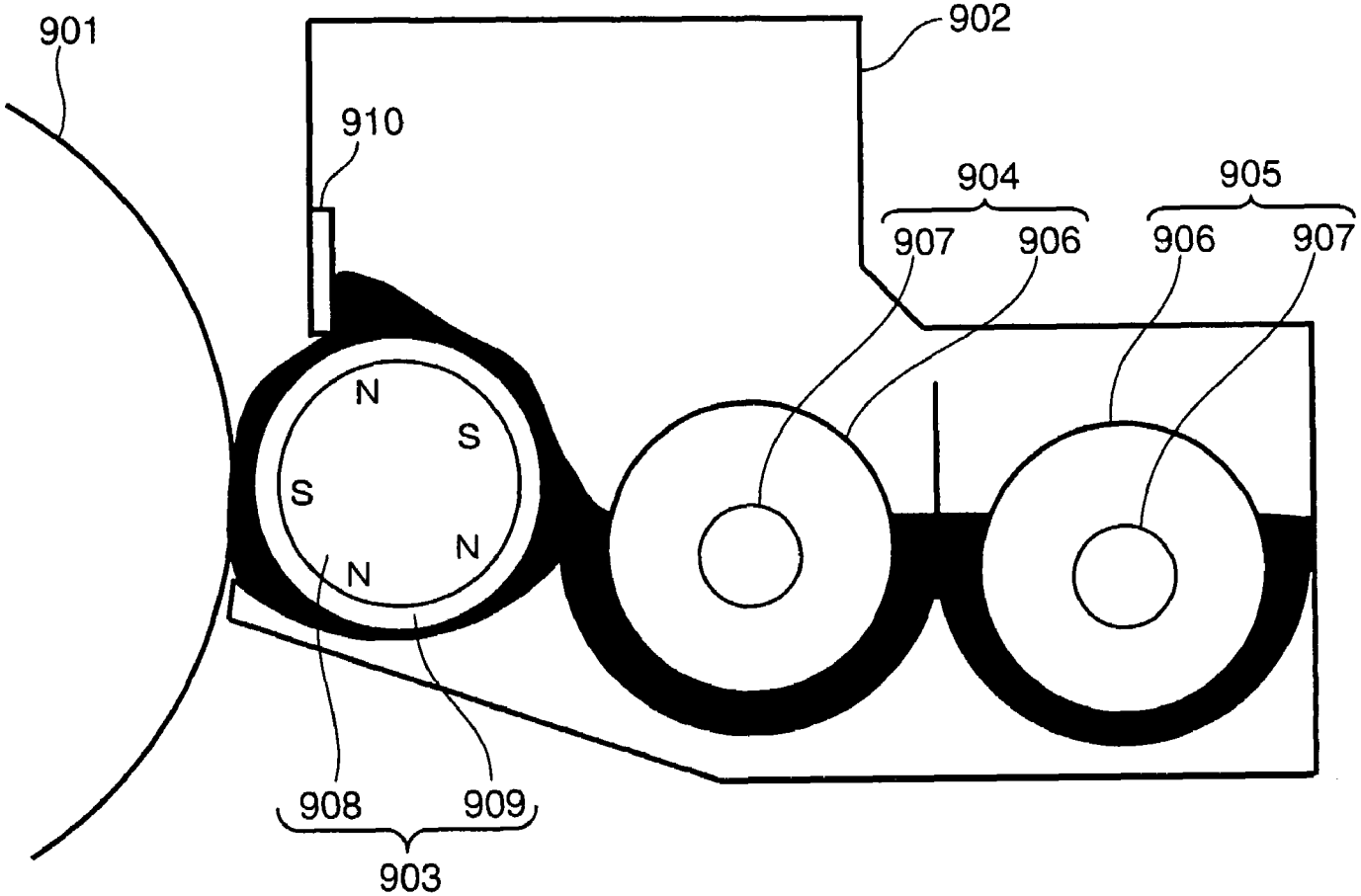
PRIOR ART FIG. 10
FIG. 10 is a section of the conventional developing device.

Further, by using a conveying screw having the larger blade portions and the smaller blade portions and an ordinary conveying screw having a blade that applies a uniform force to the toner regardless of an angle of rotation (e.g. the conveying screw 904 shown in FIG. 9) and by arranging the ordinary conveying screw at a position closer to the developing roller, the conveying force of the conveying screw closer to the developing roller can be increased. At this time, the conveying screw having the larger blade portions and the smaller blade portions has a smaller conveying force since the diameter of the blade of the ordinary conveying screw and the diameter of the larger blade portions are substantially equal.

Although the two conveying screws 104, 105 are provided in the developing device 100 of this embodiment, the number of the conveying screws provided in the developing device 100 according to the present invention is not limited to two, and may be one, three or more.

The side view of the conveying screw at the section along VB-VB of FIG. 4B is shown in FIG. 5A in this embodiment. The blade 106 comprised of the larger blade portions 501 for pressing the toner in the conveying direction and the smaller blade portions 502 having a smaller toner pressing force than the larger blade portions 501 may have a semicircular side view shown in FIG. 5C, an eccentric circular side view shown in FIG. 5D, a circular side view with a fan-shaped cutout shown in FIG. 5E or a side view approximate to any of these shapes.

The blade 106 is formed in FIGS. 4A, 4B such that adjacent parts thereof are turned (displaced) by specified angles along the circumferential direction of the rotary shaft 107. The "adjacent parts" mentioned here refer to a relationship between blade parts 403, 404 at a specified angle θ to the rotary shaft and belonging to ranges of specified widths 401, 402 in a side view when the rotary shaft is equally divided into the specified widths 401, 402 as shown in FIG. 4B.

Figure 6A:
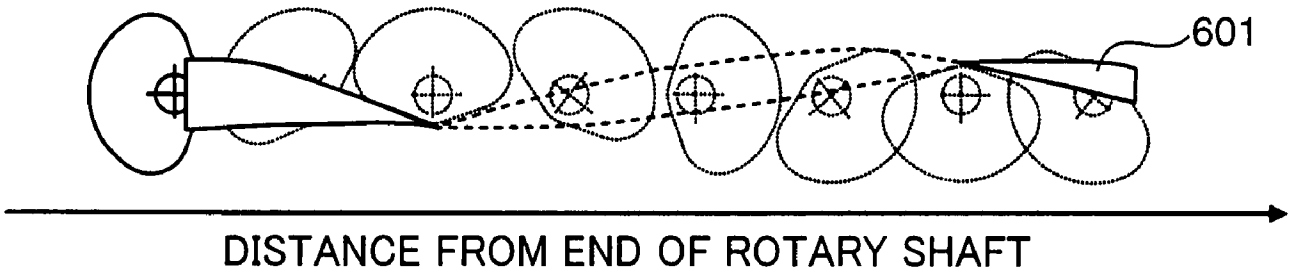
FIGS. 6A to 6C are diagrams showing a relationship between a distance from an end of a rotary shaft and a section of the blade.
Figure 6B:
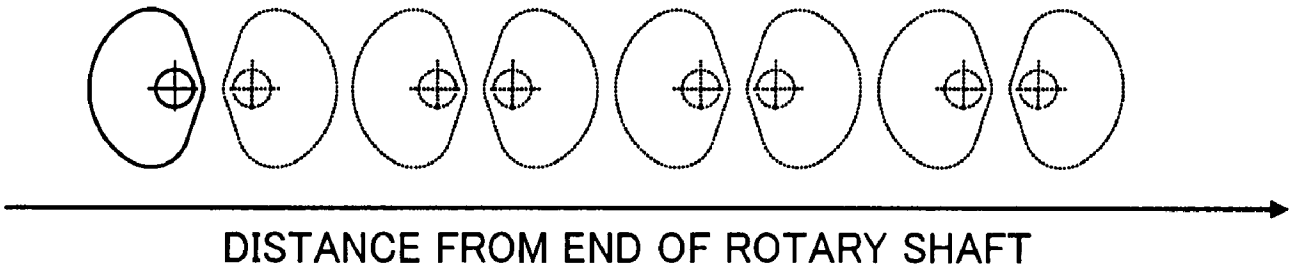

FIGS. 6A and 6B show displacements of adjacent blade parts with respect to the rotary shaft 107, using a distance from an end of the rotary shaft (horizontal axis) and sections of the blade at selected distances.

In the case of FIG. 6A, a substantially plane surface 601 having a smaller pressing force and defined by connecting the smaller blade portions of the adjacent blade parts (a virtual strip-shaped plane surface generated by connecting smaller blade areas of the respective blade parts from one end toward the other end of the rotary shaft 107) is formed to have a spiral shape from a position near the one end of the rotary shaft 107 to a position near the other end thereof. Angular displacements between the adjacent blade parts are, for example, 45° in FIGS. 6A and 180° in FIG. 6B. In the construction of FIG. 6B where the adjacent blade parts are turned by 180°, the large blade portions and the smaller blade portions are alternately arranged along the longitudinal direction of the rotary shaft 107.

Although the positions of the larger blade portions and the smaller blade portions of the blade 106 along the circumferential direction of the rotary shaft 107 differ along the axial direction of the rotary shaft 107, this construction is not essential to the present invention. However, such a construction of the conveying screw that the circumferential positions of the larger blade portions and the smaller blade portions differ along the axial direction can prevent the conveying screw from being warped at a production phase of the conveying screw.

Specifically, in the case of producing a resin-made conveying screw, resin is poured into a mold form for the conveying screw and solidified, and the solidified resin having the shape of a conveying screw is taken out of the mold form and cooled. However, the resin taken out of the mold frame is likely to warp upon being cooled. Thus, if the conveying screws 104, 105 are formed to be as symmetrical as possible with respect to the entire rotary shaft 107 by displacing the positions of the larger blade portions and the smaller blade portions along the circumferential direction of the rotary shaft 107 as in this embodiment, the production of warped conveying screws can be prevented.

Figure 6C:
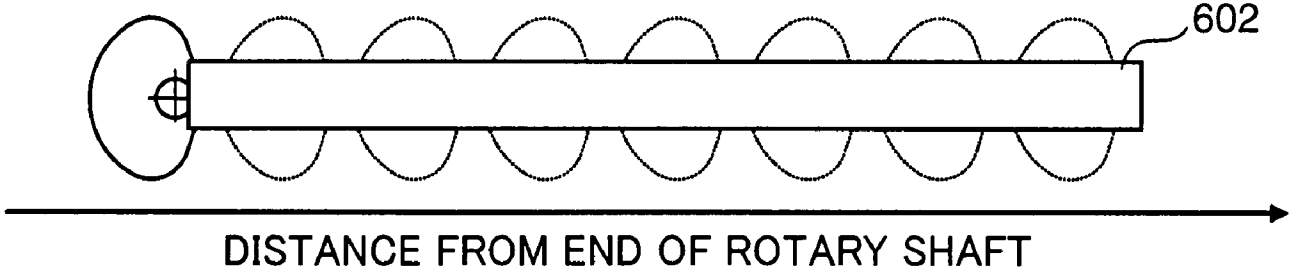

Contrary to the above construction, the adjacent blade parts are turned 360° along the circumferential direction of the rotary shaft 107 in a construction shown in FIG. 6C. In this construction, the blade 106 has a spiral shape, but a substantially plane surface 602 having a smaller pressing force and defined by connecting a plurality of the smaller blade portions of the adjacent blade parts is parallel to the rotary shaft 107 from the position near the one end of the rotary shaft 107 to the position near the other end thereof.

Although the blade 106 forms a spiral shape around the rotary shaft 107 in the above embodiment, the present invention is not limited to the spiral shape. Specifically, if the blade 106 is comprised of larger blade portions and smaller blade portions having a smaller toner pressing force than the larger blade portions, the blade 106 has a good efficiency and is capable of agitating the toner without deteriorating the toner.

For example, in FIGS. 7 and 8, blades 106 are such that larger blade portions and smaller blade portions are not connected, i.e. independently formed, although being similar in that the blade 106 is comprised of the larger blade portions and the smaller blade portions. Further, for the conveyance of toner, a plane surface of each blade portion is inclined relative to the axial direction of a rotary shaft.

Figure 7A:
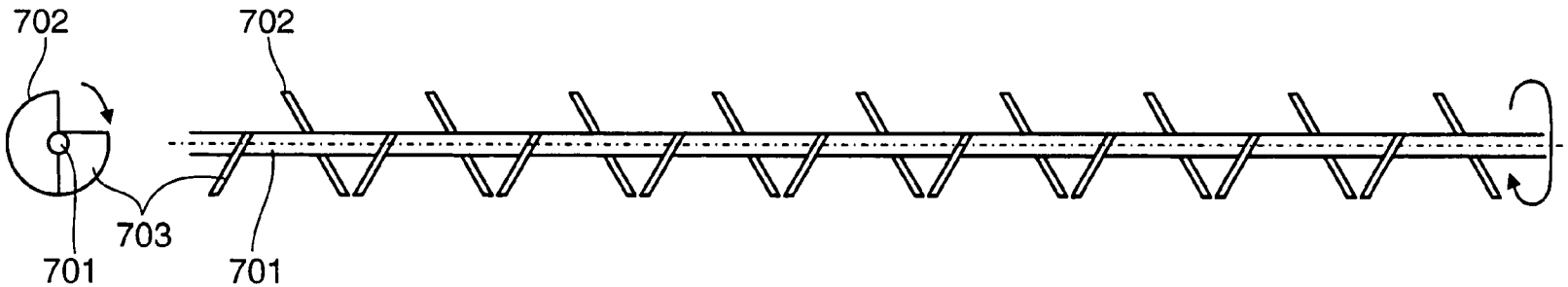
FIGS. 7A to 7C are side views showing one example of a conveying screw constructed by independent blades.

For example, a blade shown in FIG. 7A includes larger blade portions 702 having an area of 180° with respect to the rotary shaft 701 and smaller blade portions 703 having an area of 90°, wherein the larger blade portions 702 and the smaller blade portions 703 are inclined relative to the axial direction of the rotary shaft 701 and alternately arranged. A diagram at the left side of FIG. 7A is a side view of a conveying screw.

The larger blade portions 702 are for pressing toner rightward in the case where the rotary shaft 701 is rotated clockwise in the side view. The smaller blade portions 703 are also for pressing the toner rightward. However, pressing forces of the larger and smaller blade portions 702, 703 differ. A conveying force is higher in an angle range of the rotary shaft 701 from 0° to 180° since the larger blade portions 702 press the toner, wherefore a toner conveying speed is faster. In a succeeding angle range from 180° to 270°, the smaller blade portions 703 press the toner, wherefore the conveying force is smaller as compared to the conveyance by the larger blade portions and the toner conveying speed is slower. In a succeeding angle range from 270° to 360°, the toner is not conveyed because there are no blade portions. In such a construction as well, the toner conveying force differs depending on the angle of rotation of the rotary shaft. Therefore, there are sections where the flow rate of the toner is faster and those where the flow rate is slower, and the efficient agitation and the prevention of the toner deterioration can be realized.

Figure 7B:
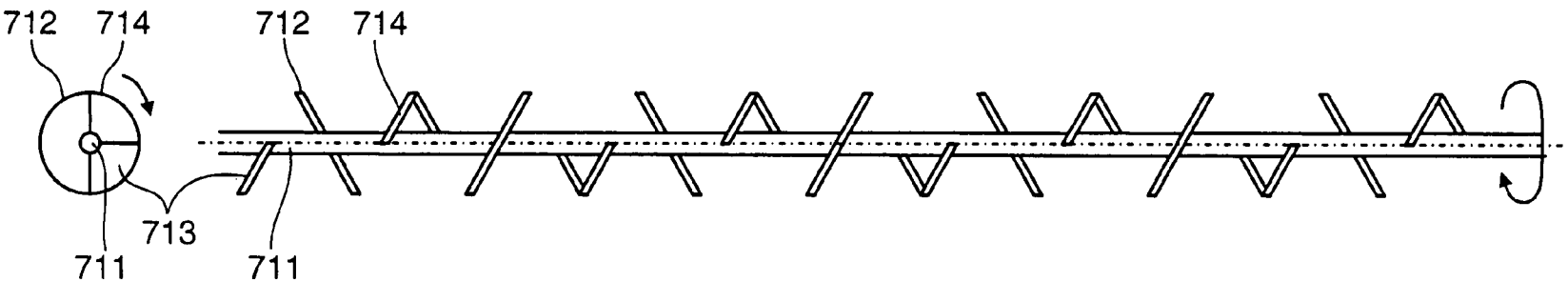

A blade shown in FIG. 7B includes larger blade portions 712 having an area of 180° with respect to a rotary shaft 711, smaller blade portions 713 having an area of 90°, and smaller blade portions 714 likewise having an area of 90°.

The larger blade portions 712 and the smaller blade portions 713, 714 press toner rightward. However, pressing forces of the larger blade portions 712 differ from those of the smaller blade portions 713, 714; the pressing forces of the blade portions 712, 713, 714 differ depending on the angle of the rotary shaft 711; and the conveyance of the toner is temporarily stopped when the pressing by the larger blade portions 712 is switched to that by the smaller blade portions 713, 714. Even in such a construction as well, a toner conveying force differs depending on the angle of rotation of the rotary shaft. Therefore, there are sections where the flow rate of the toner is faster and those where the flow rate is slower, and the efficient agitation and the prevention of the toner deterioration can be realized.

Figure 7C:
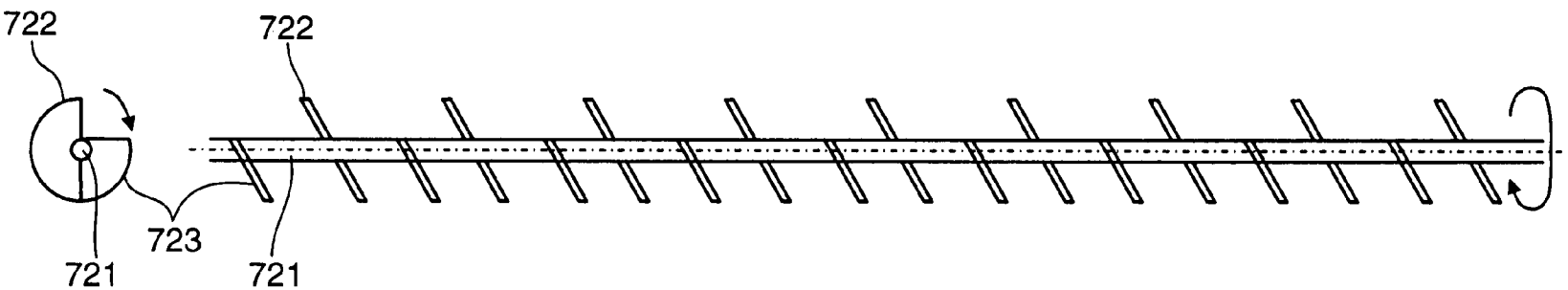

A blade shown in FIG. 7C includes larger blade portions 722 having an area of 180° with respect to a rotary shaft 721 and smaller blade portions 723 having an area of 90°, wherein the larger blade portions 722 and the smaller blade portions 723 are alternately arranged.

The larger blade portions 722 are for pressing toner rightward in the case where the rotary shaft 721 is rotated clockwise in a side view. On the other hand, the smaller blade portions 723 press the toner leftward. Although the pressing directions are opposite in this construction, the toner is conveyed in one direction since the pressing by the larger blade portions 722 is larger. Even in such a construction as well, a toner conveying force differs depending on the angle of rotation of the rotary shaft. Therefore, there are sections where the flow rate of the toner is faster and those where the flow rate is slower, and the efficient agitation and the prevention of the toner deterioration can be realized.

Figure 8A:
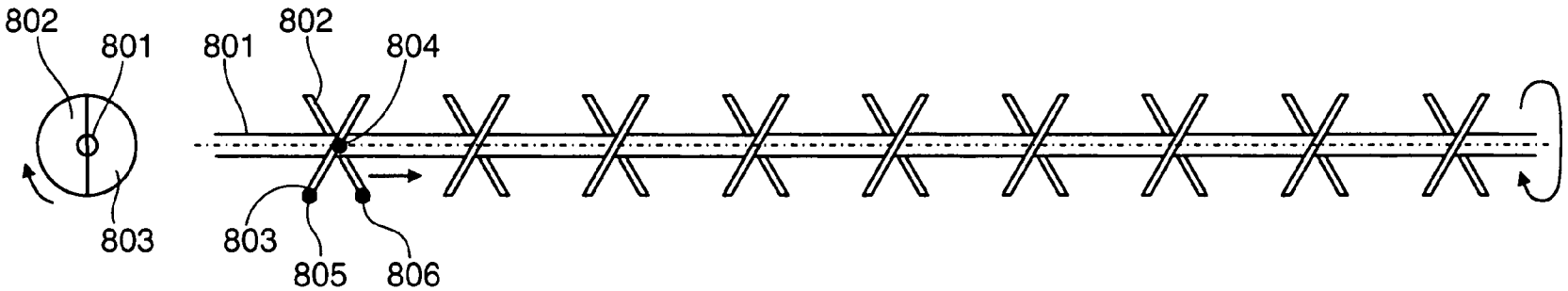
FIGS. 8A to 8C are side views showing another example of the conveying screw constructed by independent blades.

A blade shown in FIG. 8A includes larger blade portions 802, 803 having an area of 180° with respect to a rotary shaft 801, wherein two larger blade portions 802, 803 are so disposed at each point of arrangement on the rotary shaft 801 as to be inclined relative to the axial direction of the rotary shaft 801 and to press toner in the same direction by the rotation thereof.

Although a toner pressing force of the blade is thought to be equal regardless of the angle of rotation of the rotary shaft at a glance, it does differ depending on the angle of rotation of the rotary shaft when the position of the toner is considered. Specifically, the toner is moved rightward in FIG. 8A by being pressed by the larger blade portions 802. Subsequently, when a pressing task is switched to the larger blade portions 803, the larger blade portions 803 are idly rotated at first since points 805 where the larger blade portions 803 start pressing and points 806 where the pressing by the larger blade portions 802 end differ. It should be noted that the larger blade portions 803 are not completely idly rotated since the toner conveyed in a direction opposite to a conveying direction is actually present. Even in such a construction as well, a toner conveying force differs depending on the angle of rotation of the rotary shaft.

Therefore, there are sections where the flow rate of the toner is faster and those where the flow rate is slower, and the efficient agitation and the prevention of the toner deterioration can be realized.

Figure 8B:
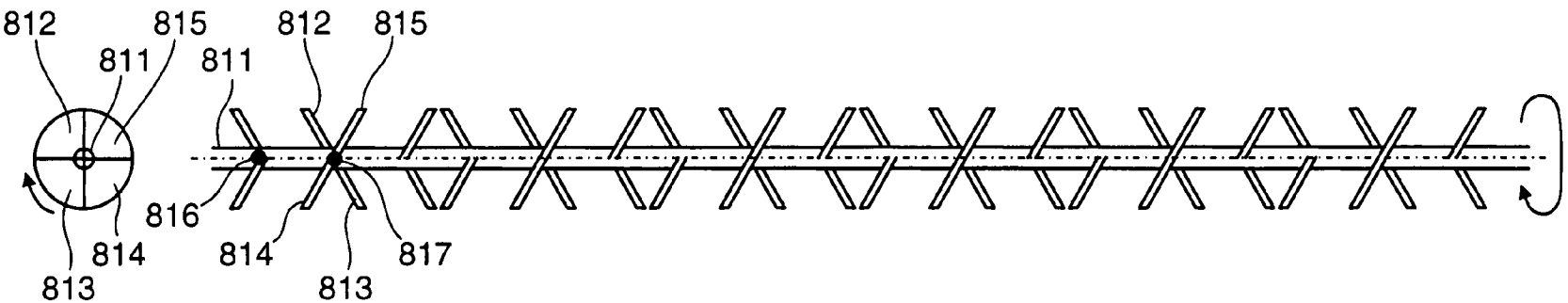

A blade shown in FIG. 8B includes smaller blade portions 812 to 815 having an area of 90° with respect to a rotary shaft 811, wherein two or four smaller blade portions 812 to 815 are so disposed at each point of arrangement 816, 817 on the rotary shaft 811 as to be inclined relative to the axial direction of the rotary shaft 811 and to press toner in the same direction by the rotation thereof. Even in such a construction as well, a toner conveying force differs depending on the angle of rotation of the rotary shaft similar to the blade shown in FIG. 8A. Therefore, there are sections where the flow rate of the toner is faster and those where the flow rate is slower, and the efficient agitation and the prevention of the toner deterioration can be realized.

Figure 8C:
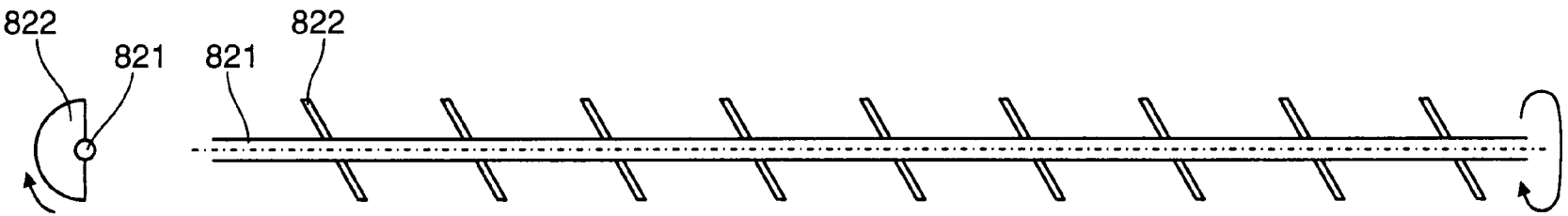

A blade shown in FIG. 8C includes larger blade portions 822 having an area of 180° with respect to a rotary shaft 821 and disposed in such a manner as to be inclined relative to the axial direction of the rotary shaft 821 and to press toner in the same direction by the rotation thereof. In this construction, the toner is conveyed by being pressed by the larger blade portions 822, for example, in an angle range of the rotary shaft 821 from 0° to 180°, whereas the toner is not conveyed due to the absence of the blade portions in a succeeding angle range from 180° to 360°. Even in such a construction as well, a toner conveying force differs depending on the angle of rotation of the rotary shaft. Therefore, there are sections where the flow rate of the toner is faster and those where the flow rate is slower, and the efficient agitation and the prevention of the toner deterioration can be realized.

This application is based on patent application Nos. 2005-98809 and 2006-47838 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A developing device, comprising:

a housing for holding toner, a conveying screw arranged in the housing, and including a rotary shaft and a blade provided on the rotary shaft for conveying the toner from one end of the rotary shaft toward the other end thereof by the rotation of the rotary shaft, and a developing roller provided in the housing in a state where a part of the developing roller being exposed from the housing, and rotatable to obtain the toner conveyed by the conveying screw, wherein a toner pressing force of the blade differs depending on the angle of rotation of the rotary shaft and wherein the blade includes larger blade portions for pressing the toner in a conveying direction and smaller blade portions having a smaller pressing force than the larger blade portions, and wherein the blade has a spiral shape continuous from a position near the one end of the rotary shaft to a position near the other end thereof, the spiral shared blade defining larger blade portions having a larger diameter and smaller blade portions having a smaller diameter than the larger blade portions with the rotary shaft as a center, the smaller blade portions being configured so that a substantially plane surface is defined by connecting a plurality of adjacent smaller blade portions and extends parallel to the rotary shaft from a position near the one end of the rotary shaft to a position near the other end thereof.

2. A developing device, comprising:

a housing for holding toner, a conveying screw arranged in the housing, and including a rotary shaft and a blade provided on the rotary shaft for conveying the toner from one end of the rotary shaft toward the other end thereof by rotation of the rotary shaft, and a developing roller provided in the housing in a state where a part of the developing roller is exposed from the housing, the developing roller being rotatable to obtain the toner conveyed by the conveying screw, wherein a toner pressing force of the blade differs depending on the angle of rotation of the rotary shaft, and wherein the blade has a spiral shape continuous from a position near the one end of the rotary shaft to a position near the other end thereof, the spiral shaped blade defining larger blade portions having a larger diameter and smaller blade portions having a smaller diameter than the larger blade portions with the rotary shaft as a center, a surface having a small pressing force and defined by connecting a plurality of adjacent smaller blade portions has a spiral shape from a position near the one end of the rotary shaft to a position near the other end thereof.

3. A developing device according to claim 2, wherein the larger blade portions and the smaller blade portions are alternately arranged along the longitudinal direction of the rotary shaft.

4. A developing device, comprising:

a housing for holding toner, a conveying screw arranged in the housing, the conveying screw including a rotary shaft and a blade provided on the rotary shaft for conveying the toner in a conveying direction from one end of the rotary shaft towards an opposed and of the rotary shaft by rotation of the rotary shaft, a developing roller provided in the housing in a state where a part of the developing roller is exposed from the housing, the developing roller being rotatable to obtain the toner conveyed by the conveying screw, wherein a toner pressing force of the blade differs depending on the angle of rotation of the rotary shaft, and wherein the blade includes larger blade portions for pressing the toner in the conveying direction and smaller blade portions provided independently of the larger blade portions and adapted to press the toner in the conveying direction, the larger blade portions and the smaller blade portions each having substantially equal radii and having the rotary shaft as the center, the larger blade portions each defining a larger surface area than the smaller blade portions.

5. A developing device according to claim 4, wherein each of the larger blade portions and the smaller blade portions are circularly generated about the rotary shaft, the large blade portions extending through a greater circumferential arc than the small blade portions.

6. A developing device, comprising:

a housing for holding toner, a conveying screw arranged in the housing, the conveying screw including a rotary shaft and a blade provided on the rotary shaft for conveying the toner in a conveying direction from one end of the rotary shaft towards an opposed and of the rotary shaft by rotation of the rotary shaft, a developing roller provided in the housing in a state where a part of the developing roller is exposed from the housing, the developing roller being rotatable to obtain the toner conveyed by the conveying screw, wherein a toner pressing force of the blade differs depending on the angle of rotation of the rotary shaft, and wherein the blade includes larger blade portions for pressing the toner in the conveying direction and smaller blade portions provided independently of the larger blade portions and adapted to press the toner in a direction opposite to the conveying direction of the toner, the larger blade portions and the smaller blade portions each having substantially equal radii and having the rotary shaft as the center, the larger blade portion each defining a larger surface are than the smaller blade portion.

7. A developing device according to claim 6, wherein each of the larger blade portions and the smaller blade portions are circularly generated about the rotary shaft, the large blade portions extending through a greater circumferential arc than the small blade portions.

8. A developing device, comprising:

a housing for holding toner, a plurality of conveying screws are arranged in parallel in the housing, each of the conveying screws including a rotary shaft and a blade provided on the rotary shaft for conveying the toner from one end of the respective rotary shaft towards the other end thereof by rotation of the respective rotary shaft, each of the blades includes larger blade portions for pressing the toner in a conveying direction and smaller blade portions having a smaller pressing force than the larger blade portions, a developing roller provided in the housing in a state where the conveying screws are at one side of the developing roller, a part of the developing roller being exposed from the housing, the developing roller being rotatable to obtain the toner conveyed by the conveying screws, wherein a toner pressing force of the blade differs depending on the angle of rotation of the rotary shaft, and a conveying ability of the conveying screw arranged at a position closer to the developing roller is set to be larger than that of the conveying screw arranged at a position more distant from the developing roller.

9. A developing device, comprising:

a housing for holding toner, a plurality of conveying screws are arranged in parallel in the housing, each of the conveying screws including a rotary shaft and a blade provided on the rotary shaft for conveying the toner from one end of the respective rotary shaft towards the other end thereof by rotation of the respective rotary shaft, each of the blades includes larger blade portions for pressing the toner in a conveying direction and smaller blade portions having a smaller pressing force than the larger blade portions, a developing roller provided in the housing in a state where the conveying screws are at one side of the developing roller, a part of the developing roller being exposed from the housing, the developing roller being rotatable to obtain the toner conveyed by the conveying screws, wherein a toner pressing force of the blade differs depending on the angle of rotation of the rotary shaft, and the size of the smaller blade portions of the conveying screw arranged at the position closer to the developing roller is set to be larger than that of the smaller blade portions of the conveying screw arranged at the position more distant from the developing roller.

* * * * *